US006336762B1

(12) United States Patent
Oike

(10) Patent No.: US 6,336,762 B1
(45) Date of Patent: Jan. 8, 2002

(54) DIRECT-FLUID-SUPPLY WRITING DEVICE

(75) Inventor: Shigeru Oike, Aichi (JP)

(73) Assignee: The Pilot Ink Co., Ltd., Aichi (JP)

( * ) Notice: Subject to any disclaimer, the term of this patent is extended or adjusted under 35 U.S.C. 154(b) by 0 days.

(21) Appl. No.: 09/504,580

(22) Filed: Feb. 15, 2000

(30) Foreign Application Priority Data

Feb. 17, 1999 (JP) ..... 11-038160

(51) Int. Cl.[7] ..... B43K 8/00
(52) U.S. Cl. ..... 401/198
(58) Field of Search ..... 401/198, 199, 401/196, 205

(56) References Cited

U.S. PATENT DOCUMENTS 4,645,367 A * 2/1987 Mutschler et al. ..... 401/199
6,113,296 A * 2/1987 Weiss ..... 401/199
4,761,090 A * 8/1988 Goh ..... 401/259
5,906,446 A * 5/1999 McCulloch et al. ..... 401/199
5,967,687 A * 10/1999 Oike ..... 401/198

FOREIGN PATENT DOCUMENTS

| | | | |
|---|---|---|---|
| DE | 42 31 978 A1 | 3/1994 | ..... B41J/27/00 |
| EP | 0 899 128 A1 | 3/1999 | ..... B43K/8/04 |
| WO | 98/17482 | 4/1998 | ..... B43K/8/08 |
| WO | 98/21052 | 5/1998 | |

* cited by examiner

*Primary Examiner*—Gregory Huson
*Assistant Examiner*—Peter DeVore
(74) *Attorney, Agent, or Firm*—Sughrue Mion, PLLC

(57) ABSTRACT

An ink occluding member made of a porous material is disposed between a pen point and an ink tank. A partition wall is disposed between the ink occluding member and the ink tank. The partition wall extends in the lengthwise direction. A first communication hole connected to the front portion of the ink occluding member provided with the pen point is formed in the front portion of the partition wall. A second communication hole connected to the rear portion of the ink occluding member is formed in the rear portion of the partition wall.

10 Claims, 7 Drawing Sheets

DIRECT-FLUID-SUPPLY WRITING DEVICE

BACKGROUND OF THE INVENTION

1. Field of the Invention

The present invention relates to a direct-fluid-supply writing device. More particularly, the present invention relates to a direct-fluid-supply writing device incorporating an ink occuluding member disposed between a pen point and an ink tank and made of a porous material.

Incidentally, it should be noted that "front" is a direction toward the pen point and the "rear" is a direction toward the ink tank.

2. Description of the Related Art

Conventionally, a direct-fluid-supply writing device has been known, which incorporates an ink occuluding member made of a porous material and serving as an ink keeping member for temporarily keeping overflowing ink when the internal pressure of an ink tank has been raised (refer to, for example, JA-B-37-12939U and JP-W-6-510491).

In JA-B-37-12939U, a fountain pen type felt pen has been disclosed, which incorporates a pipe for ink which accommodates an ink reservoir (corresponding to an ink tank according to the present invention); a filled chamber (corresponding to an ink occuluding member according to the present invention) formed in front of the ink reservoir and filled with waste felt or cotton; and a seat plate (corresponding to a partition wall according to the present invention) arranged to partition the filled chamber and the ink reservoir from each other and provided with small apertures (corresponding to communication holes according to the present invention), wherein an elongated felt member (corresponding to an ink inducing member according to the present invention) subjected to a resin process is inserted into the seat plate and the filled chamber.

The direct-fluid-supply writing device disclosed in JA-B-37-12939U is a direct-fluid-supply writing device, in which the ink tank and the pen point are directly connected to each other through the ink inducing member without passage through the ink occuluding member. Therefore, a satisfactory ink discharge characteristic from the pen point can be obtained as compared with a structure that the ink inducing member does not penetrate the ink occuluding member. However, the realized ink discharge characteristic is unsatisfactory in consideration of satisfactorily preventing leakage of ink.

The reason for this will now be described. The sizes of the voids in the capillary structure of the ink occuluding member cannot easily be uniformed in spite of an attempt to uniform the sizes of the voids. Therefore, the sizes of the voids considerably disperse. In particular, voids in the capillary structure having large sizes cannot serve as the temporary ink keeping portions. The existence of the large size voids in the capillary structure causes the overall ink keeping function of the ink occuluding member to deteriorate, causing a problem of ink leakage to easily take place. To effectively form ink keeping portions in the overall body of the ink occuluding member, the sizes of the voids in the capillary structure must previously be reduced (that is, the overall porous structure must have a dense structure).

Therefore, the direct-fluid-supply writing device disclosed in JA-B-37-12939U has small-size voids in the capillary structure of the ink occuluding member to realize a satisfactory ink leakage prevention characteristic. Therefore, ink can reliably be kept in the voids in the capillary structure of the ink occuluding member. On the other hand, air cannot smoothly be introduced into the ink tank, the pressure of which has been reduced. As a result, the ink discharge characteristic from the pen point deteriorates, causing written characters become pale and blurred.

The direct-fluid-supply writing device disclosed in JA-B-37-12939U incorporates the ink occuluding member having uniform capillary attraction. Therefore, when the device is preserved for a long time in a state where the pen point faces downwards, ink is easily concentrated in the front portion of the ink occuluding member. Thus, there is apprehension that ink outwards leaks owing to shock caused when the device is dropped or when the cap is removed. Ink concentrated to the front portion of the ink occuluding member cannot be returned into the ink tank even after the pressure in the ink tank has been reduced owing to consumption of ink. That is, ink is easily accumulated in the front portion of the ink occuluding member. Thus, there is apprehension that ink leaks from the pen point portion.

In JP-W-6-510491, a direct-fluid-supply writing device has been disclosed which has a structure that the capillary supply pipe (corresponding to the ink inducing member according to the present invention) and a capillary solution accumulating container (corresponding to the ink occuluding member according to the present invention) are brought into direct contact with each other. Moreover, the capillary supply pipe is engaged to an opening of a partition wall (corresponding to a partition wall according to the present invention) to close the opening. In addition, the capillary supply pipe engaged to the opening form voids (corresponding to the communication hole according to the present invention) having larger capillary attraction than that of the capillary solution accumulating container to cause an action of exchanging air and ink to be performed.

In general, the communication hole (the void) controls passage of ink and air between the ink tank and the ink occuluding member owing to its sizes (the capillary attraction). Therefore, an excellent dimension accuracy is required to permit communication of air and ink.

If the communication hole has an excessively large size, the capillary attraction is reduced. When the pressure in the ink tank has been reduced, smooth return of ink from the ink occuluding member to the ink tank is inhibited. As a result, outer air is introduced into the ink tank in a state where ink remains in the ink occuluding member. Therefore, the state in the ink tank in which the pressure has been reduced is canceled. When the pressure in the ink tank has been raised, the ink keeping portion cannot sufficiently keep leaked ink. Thus, there is apprehension that ink leaks from the pen point portion.

If the size of the communication hole is too small, the capillary attraction of the communication hole is enlarged. Thus, introduction of air into the ink tank having the reduced pressure is inhibited and, therefore, smooth exchange between ink and air is inhibited. As a result, the reduced-pressure state in the ink tank cannot be canceled. Hence it follows that the quantity of discharged ink from the pen point is gradually reduced from start of consumption of ink. Thus, written characters become pale and blurred.

It can be considered that the communication hole maintains the ink head pressure (density of ink×gravitational acceleration×height from the leading end of the pen point to the communication hole) owing to its capillary attraction. If the capillary attraction is insufficiently small (that is, if the sizes of voids are large), the capillary attraction is insufficient to maintain the ink head pressure. As a result, ink in the front portion of the communication hole moves downwards when the pen point faces downwards. Thus, there is apprehension that ink leaks from the pen point.

Therefore, the direct-fluid-supply writing device disclosed in JP-W-6-510491 and incorporating the ink inducing member made of the porous material, such as fibers, encounters great dispersion of sizes of the plural voids in the ink inducing member. Thus, the largest void serves as the communication hole according to the present invention which permit air blow.

To make the size of the largest void serving as the communication hole to be small so as to prevent the problem of leakage of ink from the pen point portion caused from retention of ink in the ink occuluding member, the sizes of the voids in the capillary structure of the ink inducing member in the opened portion must considerably be reduced in consideration of dispersion of the sizes of the voids. As a result, the capillary attraction of the communication hole is enlarged excessively to hardly introduce outer air into the ink tank having the reduced pressure. Thus, the state of pressure reduction in the ink tank cannot sufficiently be canceled, causing the ink discharge characteristic from the pen point to gradually deteriorate from start of ink consumption.

The direct-fluid-supply writing device disclosed in JP-W-6-510491 incorporates only one communication hole formed in the rear of the ink occuluding member. Therefore, the communication hole must have considerably large capillary attraction in consideration of the relatively high ink head pressure from the pen point. As a result, smooth ink discharge characteristic from the pen point cannot easily be obtained similarly to the above-mentioned structure.

Moreover, the ink inducing member of the direct-fluid-supply writing device disclosed in each of JP-B-37-12939 and JP-W-6-510491 is made of the porous material, such as fibers. Therefore, the overall body of the ink inducing member has great capillary attraction. Since the distance from the communication hole to the pen point is long, great resistance arises when ink passes. Thus, ink in a large quantity cannot quickly be supplied to the pen point. As a result, written characters become pale and blurred.

What is worse, the direct-fluid-supply writing device disclosed in each of JP-B-37-12939 and JP-W-6-510491 encounters insufficient supply of ink from the ink tank to the pen point when the pen point faces upwards in a case where, for example, writing on a writing board or the like is performed or when the pen point faces horizontally (when the body of the device is in a horizontal state). Thus, written characters become pale and blurred.

SUMMARY OF THE INVENTION

An object of the present invention is to provide a direct-fluid-supply writing device which is capable of simultaneously realizing a satisfactory ink discharge characteristic from the pen point and sufficient prevention of ink leakage from the pen point portion. Another object of the present invention is to provide a direct-fluid-supply writing device which is capable of continuously discharging ink even if the pen point faces upwards or horizontally.

(a) According to a first aspect of the present invention, there is provided a direct-fluid-supply writing device 1 comprising: an ink occuluding member 5 disposed between a pen point 61 and an ink tank 21 and made of a porous material; a partition wall 4 disposed between the ink occuluding member 5 and the ink tank 21; and communication holes 8 and 9 for controlling exchange of ink and air between the ink occuluding member 5 and the ink tank 21, wherein the partition wall 4 is extended in the lengthwise direction so that a first communication hole 8 connected to the front portion of the ink occuluding member 5 provided with the pen point 61 is formed in the front portion of the partition wall 4 and a second communication hole 9 connected to the rear portion of the ink occuluding member 5 is formed in the rear portion of the partition wall 4.

Improvement in Ink Discharge Characteristic

The foregoing structure enables at least the distance from the first communication hole 8 to the leading end of the pen point 61 to be shortened. Therefore, the ink head pressure of the first communication hole 8 can be reduced. As a result, the capillary attraction of the first communication hole 8 can be reduced as compared with that of the conventional structure. That is, the first communication hole 8 is able to have voids, the size of which can relatively be enlarged.

Therefore, the distance from the first communication hole 8 and the leading end of the pen point 61 can be shortened, causing the resistance of ink which passes through the ink movement passage from the first communication hole 8 to the pen point 61 can be lowered. Moreover, the sizes of voids in the first communication hole 8 can be enlarged. Therefore, the resistance of ink which passes through the first communication hole 8 can be lowered. Hence it follows that ink can smoothly be moved from the ink tank 21 to the pen point 61. As a result, interruption of written characters and a problem that written characters become pale and blurred can be prevented.

Since the sizes of voids of the first communication hole 8 can relatively be reduced, excellent dimension accuracy is not required when a manufacturing process is performed. Therefore, the manufacturing process can easily be performed.

Prevention of Ink Leakage

Ink is sometimes concentrated in the front portion of the ink occuluding member 5 owing to preservation of the direct-fluid-supply writing device for a long time in a state where the pen point faces downwards. However, ink concentrated in the front portion of the ink occuluding member 5 can smoothly be returned to the inside portion of the ink tank 21 through the first communication hole 8 after the pressure in the ink tank 21 has been reduced owing to consumption of ink. Therefore, ink does not remain in the front portion of the ink occuluding member 5. That is, leakage of ink from the pen point 61 can be prevented.

Moreover, the front portion of the ink occuluding member 5 adjacent to the first communication hole 8 and the rear portion of the ink occuluding member 5 adjacent to the second communication hole 9 serve as the first ink keeping portion and the second ink keeping portion, respectively. Therefore, the ink keeping function of the ink occuluding member 5 can effectively be exhibited in the portions across the ink occuluding member 5. Therefore, the characteristic for preventing leakage of ink from the pen point 61 can furthermore be improved.

In a second aspect of the present invention, it is preferable that the direct-fluid-supply writing device 1 according to the first aspect has a structure that an ink inducing member 6 connected to the pen point 61 and made of a porous material is inserted into the front portion of the partition wall 4, and the outer surface of the ink inducing member 6 is brought into contact with the inner surface of the front portion of the ink occuluding member 5.

The ink inducing member 6 enables ink to quickly and smoothly be supplied from the ink tank 21 to the pen point 61 and the front portion of the ink occuluding member 5.

Moreover, ink kept in the front portion of the ink occuluding member 5 can quickly and smoothly be returned to the ink tank 21. Thus, the ink discharge characteristic and the characteristic for preventing leakage of ink can furthermore be improved.

In a third aspect of the present invention, it is preferable that the direct-fluid-supply writing device 1 according to the first or second aspect has a structure that the partition wall 4 is constituted by a cylindrical portion 41 inserted into the ink occuluding member 5 and a flange 42 continuously formed from the rear end of the cylindrical portion 41 and brought into contact with the rear end of the ink occuluding member 5. Moreover, the first communication hole 8 for causing the front portion of the ink occuluding member 5 provided with the pen point 61 and the ink tank 21 to communicate with each other is formed in the front end of the cylindrical portion 41. In addition, the second communication hole 9 for causing the rear end of the ink occuluding member 5 and the ink tank 21 to communicate with each other is formed in the flange 42.

Since the partition wall 4 is constituted by the cylindrical portion 41 and the flange 42, the first communication hole 8 and the second communication hole 9 of the direct-fluid-supply writing device 1 according to the first or second aspect can effectively be formed.

In a fourth aspect of the present invention, it is preferable that the direct-fluid-supply writing device 1 according to the first aspect is structured such that compressing portions 51 and 52 for making capillary attraction of the ink occuluding member 5 to be larger than capillary attraction of the other portions is provided for a portion adjacent to the first communication hole 8 of the ink occuluding member 5 and/or a portion adjacent to the second communication hole 9 of the ink occuluding member 5.

The compressing portions 51 and 52 enable ink to always be concentrated in the vicinity of the communication holes 8 and 9 of the ink occuluding member 5 even if the pen point 61 is caused to face downwards. Thus, an ink barrier for preventing introduction of air occurring when the pressure in the ink tank 21 has been reduced can be formed in the foregoing portion. As a result, continuous return of ink from the ink occuluding member 5 to the ink tank 21 can be performed without including any air when the pressure in the ink tank 21 has been reduced.

It is preferable that the compressing portion 52 is formed adjacent to the second communication hole 9. The ink head pressure from the leading end of the pen point 61 is higher in the portion adjacent to the second communication hole 9 as compared with the ink head pressure in the void of the first communication hole 8. Therefore, ink can easily be moved in the downward direction. To keep ink in a sufficiently large quantity to prevent introduction of air, it is effective to form the compressing portion 52.

In a fifth aspect of the present invention, it is preferable that the direct-fluid-supply writing device 1 has a structure that an ink keeping member 22 connected to the rear end of the ink inducing member 6 and made of a porous material is disposed in the rear of the first communication hole 8.

As a result, when the ink accumulated in the ink tank 21 and the ink inducing member 6 are disconnected in a state where the pen point faces upwards or horizontally, the ink keeping member 22 connected to the ink inducing member 6 is disposed adjacent to the ink tank 21 of the partition wall 4. As a result, ink kept in the ink keeping member 22 can be supplied to the pen point 61 through the ink inducing member 6. Therefore, interruption of written characters and blur of the same can be prevented. The foregoing function is effective when writing on a standing writing board, such as a white board, is performed.

PREFERRED EMBODIMENTS OF THE INVENTION

Figure 1:
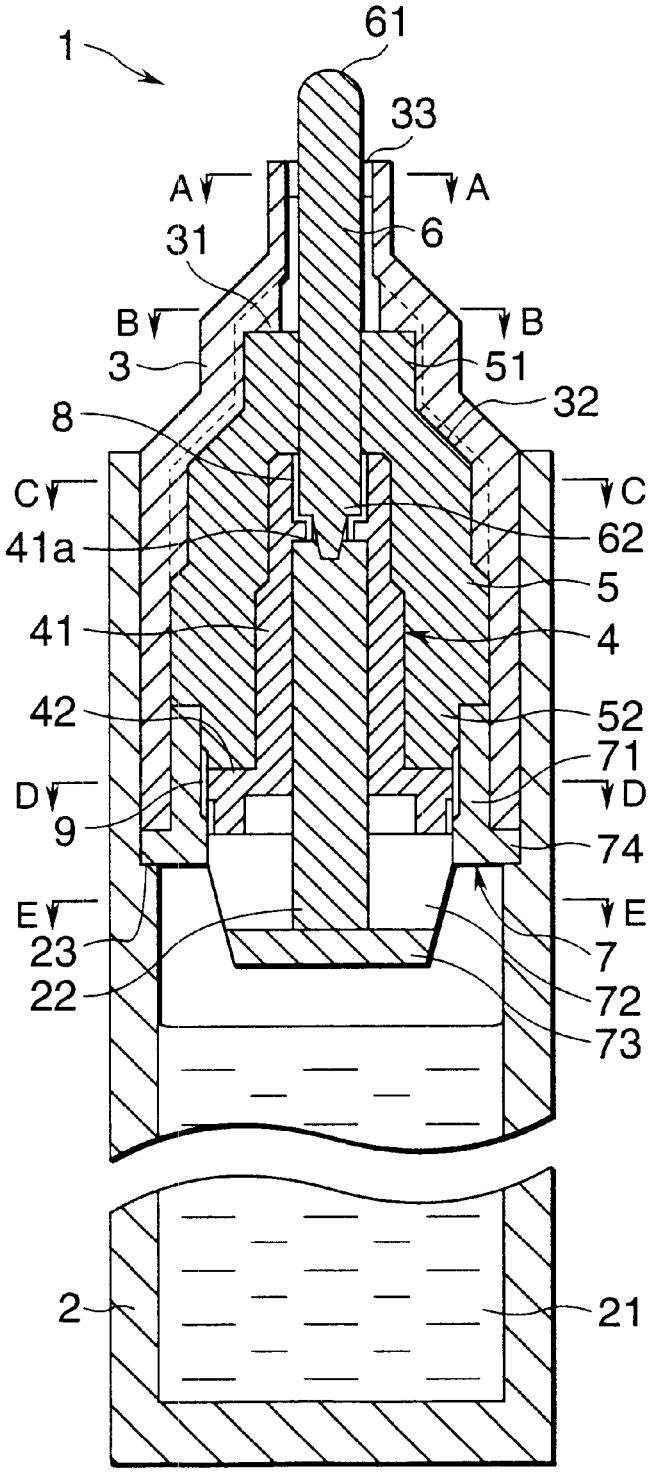
FIG. 1 is a vertical cross sectional view showing a first embodiment of the present invention.

Preferred embodiments of the present invention will now be described with reference to the accompanying drawings.

[First Embodiment]

FIGS. 1 to 6 show a first embodiment of the present invention.

A direct-fluid-supply writing device 1 according to this embodiment incorporates an occuluding-member accommodating pipe 3 for holding a pen point 61 in the front portion thereof and accommodating an ink occuluding member 5; a partition-wall holding member 7 secured to the inside surface of the rear opening of the occuluding-member accommodating pipe 3; a cylindrical partition wall 4 secured to the inside surface of the partition-wall holding member 7; an ink inducing member 6 secured to the front end of the partition wall 4 and also serving as the pen point 61; and a cylinder 2 having the inner surface to which the occuluding-member accommodating pipe 3 is secured and a rear portion provided with an ink tank 21.

(Partition Wall)

The partition wall 4 is a cylindrical member extending in the lengthwise direction and incorporating a cylindrical portion 41 and a disc-like flange 42 formed continuously from the rear end of the cylindrical portion 41, the partition wall 4 being constituted by molded synthetic resin (non-porous member). The flange 42 is press-fit and secured to the inside surface of the partition-wall holding member 7.

A plurality (four in this embodiment) of grooves extending in the axial direction are formed in the inner surface of the front end opening of the cylindrical portion 41. An ink inducing member 6 made of a porous material is press-fit into the cylindrical portion 41. Thus, a plurality (four in this embodiment) of first communication holes 8 in the form of slots are formed between the ink inducing member 6 and the inner surface of the front end opening of the cylindrical portion 41. Note that the intervals $S_1$ of the first communication holes 8 in the radial direction is 0.05 mm.

A prevention wall 41*a* brought into contact with a shoulder portion 62 formed in the rear end portion of the ink inducing member 6 and arranged to prevent rearward movement of the ink inducing member 6 is formed in the rear portion of the inner surface of the front end opening of the cylindrical portion 41 having the grooves. The grooves extend in the front surface and the inner surface of the prevention wall 41*a*.

An ink keeping member 22 made of a porous material (for example, a processed fiber bundle of synthetic resin) is accommodated in the cylindrical portion 41. The front end of the ink keeping member 22 is brought into contact with the rear end surface of the prevention wall 41*a*. Thus, the forward movement of the ink keeping member 22 is prevented. The rear end of the ink inducing member 6 is pierced in and connected to the front end of the ink keeping member 22.

(Partition-Wall Holding Member)

The partition-wall holding member 7 incorporates a cylindrical press-fit cylindrical portion 71 having an outer surface which is press-fit into the inner surface of the rear end opening of the occuluding-member accommodating pipe 3 and an inner surface to which the partition wall 4 is secured; radiating ribs 72 formed continuously from the rear end of the press-fit cylindrical portion 71; a bottom wall 73 formed continuous from the rear end of the radiating ribs 72; and an annular projection 74 formed continuously from the rear end outer surface of the press-fit cylindrical portion 71. The partition-wall holding member 7 is obtained by molding synthetic resin.

A plurality (six in this embodiment) of grooves extending in the axial direction are formed in the inner surface of the press-fit cylindrical portion 71. When the outer surface of the flange 42 of the partition wall 4 is press-fit and secured to the inner surface of the press-fit cylindrical portion 71, a plurality (six in this embodiment) of slot-shape second communication holes 9 are formed between the inner surface of the press-fit cylindrical portion 71 and the outer surface of the flange 42. The second communication holes 9 are circular-arc or rectangle elongated holes formed at predetermined intervals when the second communication hole 9 are viewed in the lateral cross section. The radial direction intervals $S_2$ is 0.03 mm.

The front end surface of the radiating ribs 72 are brought into contact with the rear end of the partition wall 4 (that is, the rear end of the flange 42) to prevent rearward movement of the partition wall 4. An ink keeping member 22 is disposed at the axis of the radiating ribs 72. Ink supply passage for permitting flow of ink between the ink tank 21 and the ink keeping member 22 and between the ink tank 21 and the second communication hole 9 are formed among the radiating ribs 72. The bottom wall 73 formed continuously from the rear end of the radiating ribs 72 is brought into contact with the rear end of the ink keeping member 22 to prevent rearward movement of the ink keeping member 22.

The front surface of the annular projection 74 is brought into contact with the rear end of the occuluding-member accommodating pipe 3. On the other hand, the rear end surface of the annular projection 74 is brought into contact with a stepped portion 23 formed on the inner surface of a cylinder 2. That is, the annular projection 74 is longitudinally held by the rear end of the occuluding-member accommodating pipe 3 and the stepped portion 23 of the cylinder 2.

(Occuluding-Member Accommodating Pipe)

The occuluding-member accommodating pipe 3 is a cylindrical member having a tapered front portion which holds the pen point 61 and accommodating the ink occuluding member 5. A plurality (four in this embodiment) of grooves extending in the axial direction are formed in the inner surface of the front portion of the tapered portion. An air passage 33 is formed between the inner surface of the occuluding-member accommodating pipe 3 and the outer surface of the pen point 61. The cylindrical partition-wall holding member 7 is press-fit and secured to the inner surface of the rear end opening of the occuluding-member accommodating pipe 3.

The occuluding-member accommodating pipe 3 accommodates the ink occuluding member 5 constituted by a member obtained by fusing a synthetic resin fiber bundle (for example, a fiber bundle of polyester resin oriented in the lengthwise direction) with heat.

The cylindrical portion 41 of the partition wall 4 is inserted into the ink occuluding member 5 from a rear position. The front portion of the ink occuluding member 5 is brought into contact with the front end of the cylindrical portion 41. On the other hand, the rear end of the ink occuluding member 5 is brought into contact with the front surface of the flange 42 of the partition wall 4.

The ink occuluding member 5 is compressed inwards in the radial direction by the inner surface of the front portion of the occuluding-member accommodating pipe 3 and the inner surface of the press-fit cylindrical portion 71 of the partition-wall holding member 7. That is, the first compressing portion 51 is formed adjacent to the first communication hole 8 and the second compressing portion 52 is formed adjacent to the second communication hole 9.

A plurality (eight in this embodiment) of prevention ribs 31 extending in the axial direction and a plurality (four in this embodiment) of air blowing ribs 32 formed continuously from the rear ends of the prevention ribs 31 and extending in the axial direction are provided for the inner surface of the occuluding-member accommodating pipe 3. The prevention ribs 31 are brought into contact with the front end of the ink occuluding member 5 to support the front end so that separation of the ink occuluding member 5 is prevented. The rear ends of the air blowing ribs 32 reach an intermediate portion of the ink occuluding member 5 (that is, a position between the front portion of the ink occuluding member 5 and the rear portion of the same). Thus, the air passage 33 is formed between the outer surface of the front portion of the ink occuluding member 5 and the inner surface of the occuluding-member accommodating pipe 3. Thus, air in the intermediate portion of the ink occuluding member 5 can be discharged to the outside without confining of air in the intermediate portion of the ink occuluding member 5.

(Ink Inducing Member)

The rod-shape ink inducing member 6 constituted by processed synthetic resin fibers (for example, polyester fibers or acrylic fibers) is inserted into the front portion of the ink occuluding member 5. The rear end of the ink inducing member 6 is exposed to the surface of the partition wall 4 adjacent to the ink tank 21. Moreover, the outer surface of the ink inducing member 6 and the inner surface of the front portion of the ink occuluding member 5 are brought into direct contact with each other. In particular, the other surface of the ink inducing member 6 is strongly brought into contact with the inner surface of the front portion of the ink occuluding member 5 in the radial direction by the first compressing portion 51 inwards compressed and deformed from the outside of the front portion of the ink occuluding member 5 in the radial direction. Thus, ink continuation between the ink occuluding member 5 and the ink inducing member 6 can be stabilized. Moreover, separation of the ink inducing member 6 from the front portion of the cylinder 2 can be prevented.

(Pen Point Unit)

The partition wall 4, the partition-wall holding member 7, the ink occuluding member 5, the ink inducing member 6 and the ink keeping member 22 are accommodated in the occuluding-member accommodating pipe 3 so that a pen point unit is constituted. When the pen point unit is introduced into the cylinder 2 filled with ink, the direct-fluid-supply writing device 1 is manufactured. The foregoing assembling method facilitates manufacture and assembly.

(Capillary Attraction)

The magnitude of the capillary attraction of each of the ink inducing member 6, the ink keeping member 22 and the ink occuluding member 5 made of the porous material will now be described. The magnitude of the ink inducing member 6, that of the ink keeping member 22 and that of the ink occuluding member 5 are reduced in the foregoing order (that is, the capillary attraction of the ink inducing member 6>that of the ink keeping member 22>that of the ink occuluding member 5). Thus, flow of ink from the ink tank 21 to the pen point 61 (that is, the ink tank 21→the ink keeping member 22→the ink inducing member 6→the pen point 61) and flow of ink between the ink tank 21 and the ink occuluding member 5 are smoothed.

The capillary attraction of the second communication hole 9 is larger than that of the first communication hole 8 because the ink head pressure from the leading end of the pen point 61 is high (that is, the capillary attraction of the second communication hole 9>the capillary attraction of the first communication hole 8).

It is preferable that the magnitude of the first compressing portion 51 and the second compressing portion 52 of the ink occuluding member 5 will now be described. The magnitude is made such that the capillary attraction of the second compressing portion 52 is the same as or larger than the capillary attraction of the first compressing portion 51 (that is, the capillary attraction of the second compressing portion 52≧the capillary attraction of the first compressing portion 51) because of the difference in the ink head pressure from the leading end of the pen point 61.

(First Communication Hole)

The first communication hole 8 according to the present invention is formed in the front portion of the cylindrical portion 41 into which the ink inducing member 6 is inserted. In this embodiment, the first communication hole 8 is formed between the outer surface of the ink inducing member 6 and the inner surface of the cylindrical portion 41 of the partition wall 4 by inserting the ink inducing member 6 into the cylindrical portion 41 having the grooves formed in the inner surface thereof. As an alternative to this, pits and projections on the outer surface of the ink inducing member 6 or voids in the ink inducing member 6 may be used.

(Second Communication Hole)

The second communication hole 9 according to the present invention is formed between the outer surface of the flange 42 of the partition wall 4 and the inner surface of the press-fit cylindrical portion 71 by press-fitting the flange 42 of the partition wall 4 into the press-fit cylindrical portion 71 having the grooves formed in the inner surface thereof. Another structure may be employed in which the second communication hole 9 is formed between the outer surface of the flange 42 and the inner surface of the press-fit cylindrical portion 71 by press-fitting the flange 42 having the grooves formed on the outer surface thereof into the inner surface of the press-fit cylindrical portion 71. Another structure may be employed in which a penetrating hole is formed in the flange 42 of the partition wall 4.

(Ink Keeping Member)

The ink keeping member 22 prevents interruption and blur of written characters occurring due to insufficient supply of ink in a state where the pen point faces upwards or horizontally. If the ink keeping member 22 is omitted, no adverse influence is exerted on the ink discharge characteristic and the ink leakage preventing characteristic in a state where the pen point faces downwards.

(Ink Tank)

Ink for a white board having a surface tension of 20 mN/m to 25 mN/m (milli-Newton/meter) is enclosed in the ink tank 21 according to this embodiment. As an alternative to this, any one of a variety of oil based ink or water base ink may be employed.

[Second Embodiment]

Figure 2:
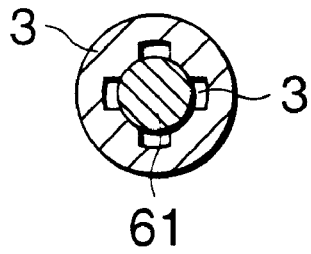
FIG. 2 is a cross sectional view taken along line A—A shown in each of FIGS. 1 and 7.
Figure 3:
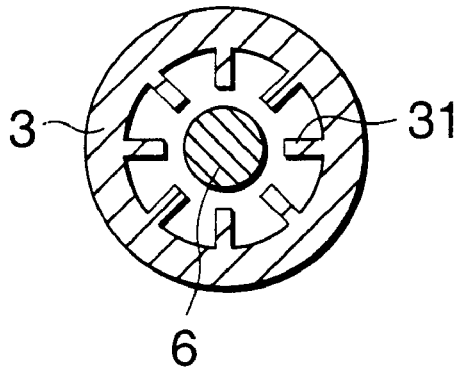
FIG. 3 is a cross sectional view taken along line B—B shown in each of FIGS. 1 and 7.
Figure 4:
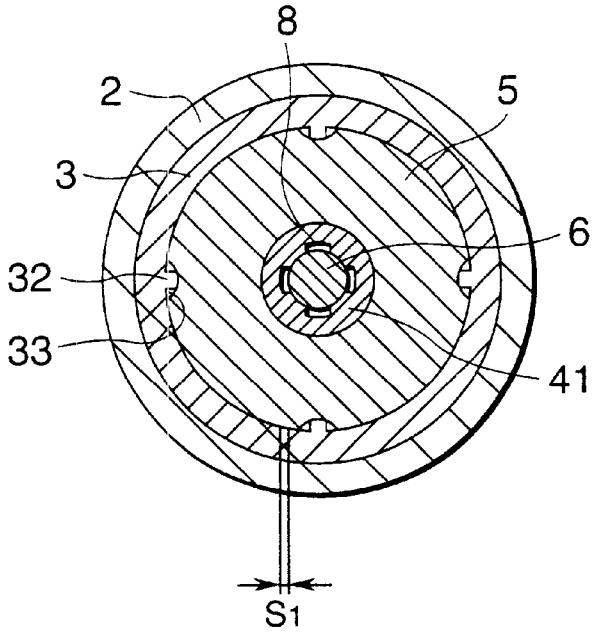
FIG. 4 is a cross sectional view taken along line C—C shown in each of FIGS. 1 and 7.
Figure 5:
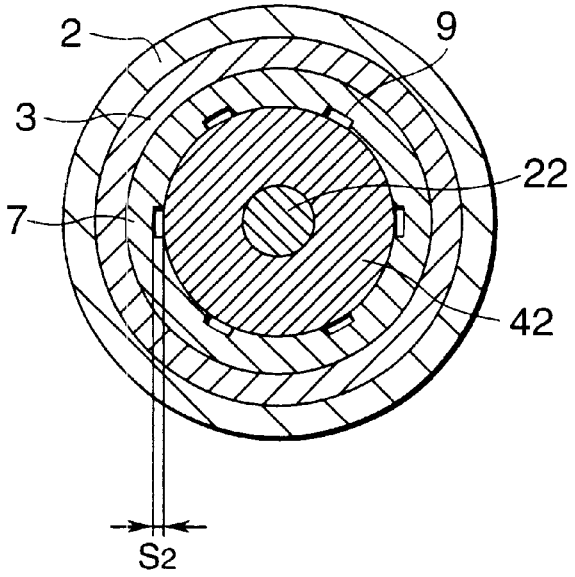
FIG. 5 is a cross sectional view taken along line D—D shown in FIG. 1.
Figure 6:
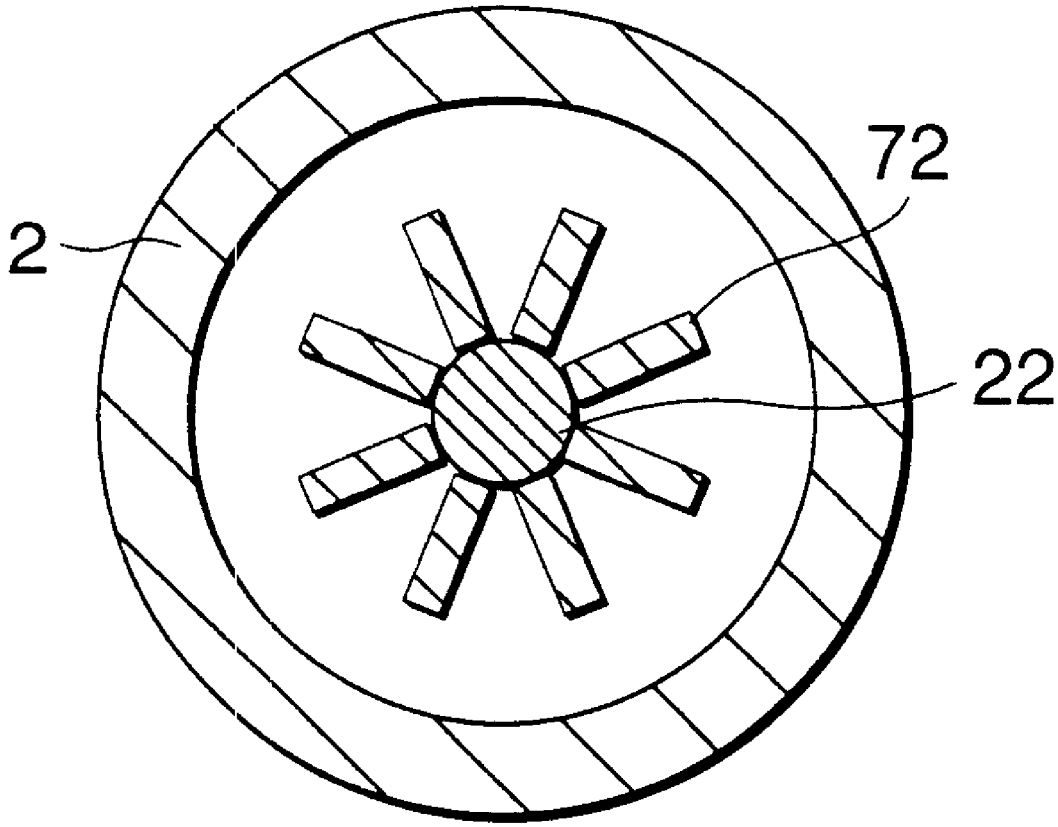
FIG. 6 is a cross sectional view taken along line E—E shown in FIG. 1.
Figure 7:
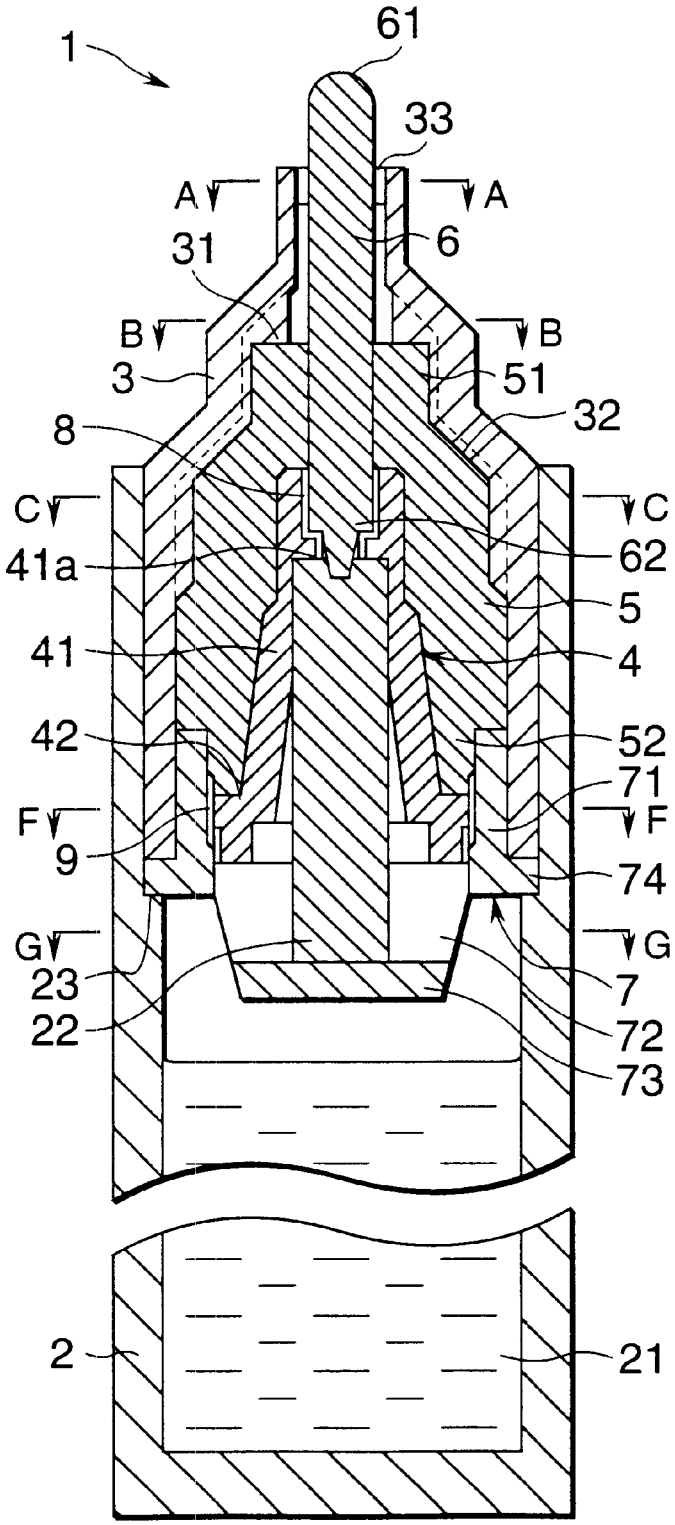
FIG. 7 is a vertical cross sectional view showing a second embodiment of the present invention.
Figure 8:
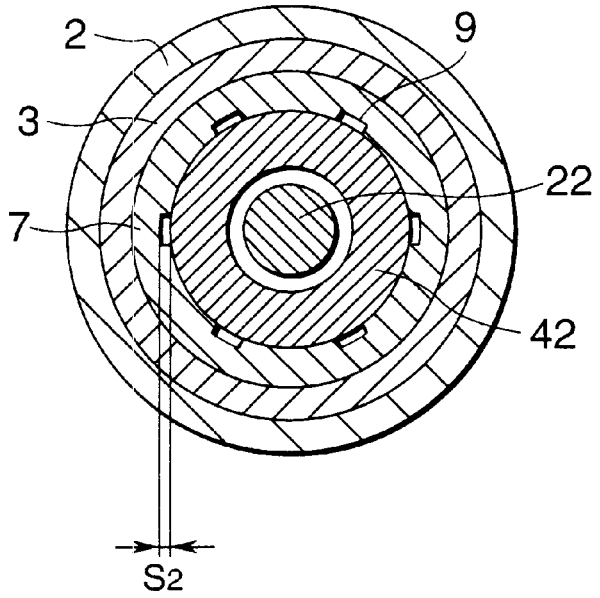
FIG. 8 is a cross sectional view taken along line F—F shown in FIG. 7.
Figure 9:
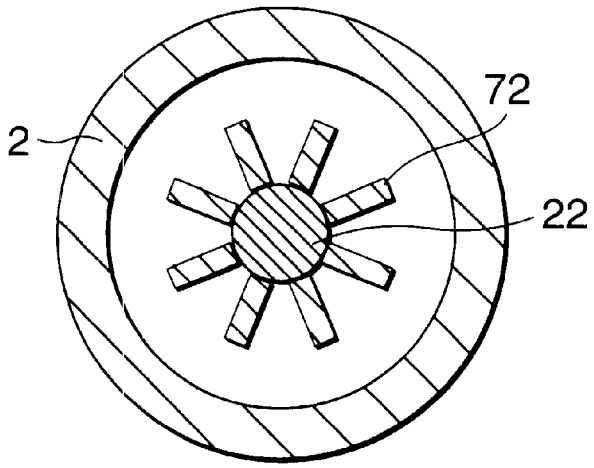
FIG. 9 is a cross sectional view taken along line G—G shown in FIG. 7.

FIGS. 7 to 9 show a second embodiment of the present invention (note that FIGS. 2 to 4 are common figures to the first embodiment).

A direct-fluid-supply writing device 1 according to this embodiment is a modification of the first embodiment. Similarly to the first embodiment, the direct-fluid-supply writing device 1 incorporates an occuluding-member accommodating pipe 3 which holds the pen point 61 in the front portion thereof and which accommodates an ink occuluding member 5; a partition-wall holding member 7 secured to the inner surface of the opening at the rear end of the occuluding-member accommodating pipe 3; a cylindrical partition wall 4 secured to the inner surface of the partition-wall holding member 7; an ink inducing member 6 secured to the front end of the partition wall 4 and also serving as the pen point 61; and a cylinder 2 having the inner surface of the front portion thereof to which the occuluding-member accommodating pipe 3 is secured and a rear portion in which the ink tank 21 is formed.

This embodiment is different from the first embodiment in that the outer surface of the cylindrical portion 41 of the partition wall 4 is formed into a tapered shape, the diameter of which is rearwards enlarged. Moreover, the front portion of the second communication hole 9 in the inner surface of the press-fit cylindrical portion 71 of the partition-wall holding member 7 is formed into a tapered shape, the diameter of which is rearwards reduced. Thus, the rear portion of the ink occuluding member 5 is gradually densely compressed in the rearward direction. Therefore, the capillary attraction of the ink occuluding member 5 is gradually enlarged in the rearward direction. As a result, when the pressure in the ink tank 21 has been reduced, ink in the rear portion of the ink occuluding member 5 can smoothly and continuously be returned from the front portion to the rear portion into the ink tank 21. As a result, accumulation of ink in the rear portion of the ink occuluding member 5 can furthermore satisfactorily be prevented. Note the other structures are similar to those of the first embodiment.

[Other Structures]

The porous material for constituting the ink occuluding member 5, the ink inducing member 6 and the ink keeping member 22 may be any one of a fused fiber bundle, a material obtained by processing a fiber bundle with resin, a material obtained by processing felt with resin, a felt subjected to a needle-punch process, continuous pore resin, continuous pore metal and continuous pore ceramic.

The structures of the pen point 61 and the ink inducing member 6 according to the present invention are, as shown in FIGS. 1 and 7, arranged such that the pen point 61 and the ink inducing member 6 are constituted by a single member.

Figure 10:
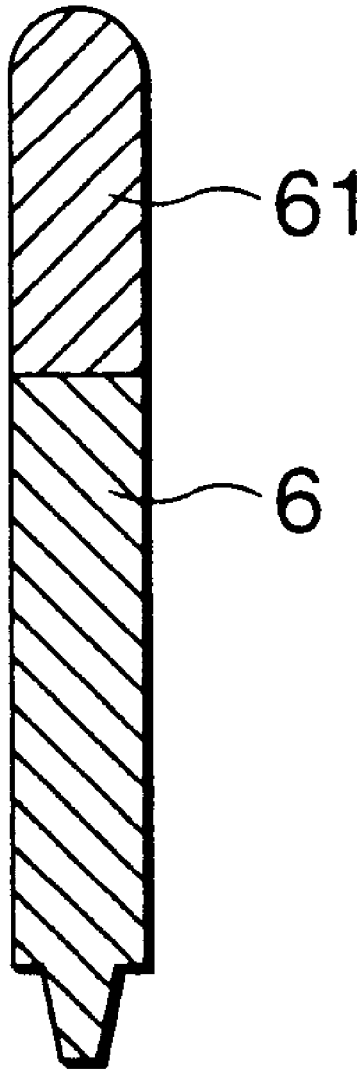
FIG. 10 is a vertical cross sectional view showing another embodiment of the pen point.

Moreover, the leading end of the ink inducing member 6 also serves as the pen point 61. Another structure as shown in FIG. 10 may be employed in which a pen point 61 which is an individual member is connected to the leading end of the ink inducing member 6. The individual pen point 61 may be any one of a porous pen member, a ball-point pen chip, a plate-shape pen member like the fountain pen, a capillary pen member, a penicillate pen member and a synthetic resin pen member having an ink passage formed in the axial direction thereof.

The partition wall 4 according to the present invention partitions the ink tank 21 and the portion for accommodating the ink occuluding member 5 from each other. It is preferable that the partition wall 4 is made of a non-porous material. The partition wall 4 may be integrally formed with the cylinder 2 as a substitute for the structure according to this embodiment in which the individual member is joined to the cylinder 2.

Note that the ink tank 21 must be connected such that communication of ink to and from the ink occuluding member 5 is permitted. Specifically, any one of the following structures may be employed: a structure that the ink tank 21 is integrally formed with the cylindrical member (for example, the cylinder 2, the occuluding-member accommodating pipe 3, the partition-wall holding member 7 or the partition wall 4) for accommodating the ink occuluding member 5; and a structure that an individual member (for example, a detachable and interchangeable ink cartridge) which is joined to the cylindrical member.

The direct-fluid-supply writing device according to the present invention and having the structure of the first aspect enables the ink flow resistance from the first communication hole to the pen point to be reduced, causing ink to smoothly flow from the ink tank to the pen point. Therefore, interruption of written characters and blur can be prevented. Moreover, ink is not left in the front portion of the ink occuluding member when the pressure in the ink tank has been reduced. Therefore, leakage of ink from the pen point portion can furthermore effectively be prevented. Hence it follows that the ink keeping function of the ink occuluding member can effectively be exhibited. As a result, leakage of ink from the pen point portion can satisfactorily be prevented and a sufficient ink discharge characteristic from the pen point can be obtained.

The direct-fluid-supply writing device according to the present invention and having the structure of the second aspect enables ink in the ink tank to quickly and smoothly be supplied to the pen point and the front portion of the ink occuluding member. Moreover, ink kept in the front portion of the ink occuluding member can quickly and smoothly be returned into the ink tank. Hence it follows that the ink discharge characteristic and ink leakage preventing characteristic can furthermore be improved.

The direct-fluid-supply writing device according to the present invention and having the structure of the third aspect enables the first and second communication holes claimed in claims 1 and 2 to effectively be formed.

The direct-fluid-supply writing device according to the present invention and having the structure of the fourth aspect permits ink to continuously be returned from the ink occuluding member to the ink tank without any confining of air when the pressure in the ink tank has been reduced. Therefore, ink is not left in the ink occuluding member and, therefore, leakage of ink from the pen point portion can furthermore effectively be prevented.

The direct-fluid-supply writing device according to the present invention and having the structure of the fifth aspect causes ink kept in the ink keeping member to be supplied to the pen point through the ink inducing member if ink in the ink tank and the ink inducing member are disconnected when the pen point faces upwards or horizontally. Therefore, interruption and blur of written characters can be prevented.

What is claimed is:

1. A direct-fluid-supply writing device comprising:

a pen point;

an ink tank;

an ink occuluding member disposed between said pen point and said ink tank, which is made of a porous material;

a partition wall disposed between said ink occuluding member and said ink tank; and first and second communication holes for controlling exchange of ink and air being provided between said ink occuluding member and said ink tank, wherein said partition wall is extended in a lengthwise direction so that said first communication hole connected to a front portion of said ink occuluding member provided with said pen point is formed in a front portion of said partition wall, and said second communication hole connected to a rear portion of said ink occuluding member is formed in a rear portion of said partition wall.

2. The direct-fluid-supply writing device according to claim 1, further comprising an ink inducing member, wherein said ink inducing member, which is connected to said pen point and is made of a porous material, is inserted into said front portion of said partition wall, and an outer surface of said ink inducing member is brought into contact with an inner surface of said front portion of said ink occuluding member.

3. The direct-fluid-supply writing device according to claim 2, wherein said first communication hole is formed between said outer surface of said ink inducing member and an inner surface of a front portion of said partition wall.

4. The direct-fluid-supply writing device according to claim 1, wherein said partition wall comprises a cylindrical portion inserted into said ink occuluding member and a flange continuously formed from a rear end of said cylindrical portion, said flange being brought into contact with a rear end of said ink occuluding member, and wherein said first communication hole for causing said front portion of said ink occuluding member provided with said pen point and said ink tank to communicate with each other is formed in a front end of said cylindrical portion, and said second communication hole for causing said rear end of said ink occuluding member and said ink tank to communicate with each other is formed in said flange.

5. The direct-fluid-supply writing device according to claim 4, wherein said second communication hole is formed between an outer surface of said flange of said partition wall and an inner surface of a press-fit portion into which said outer surface of said flange is press-fit.

6. The direct-fluid-supply writing device according to claim 1, wherein first and second compressing portions for making a capillary attraction of said ink occuluding member to be larger than a capillary attraction of other portions are provided for a portion adjacent to at least one of said first communication hole of said ink occuluding member and a portion adjacent to said second communication hole of said ink occuluding member.

7. The direct-fluid-supply writing device according to claim 6, wherein a capillary attraction of said second compressing portion is the same as a capillary attraction of said first compressing portion or larger than said capillary attraction of said first compressing portion.

8. The direct-fluid-supply writing device according to claim 1, further comprising an ink keeping member connected to a rear end of an ink inducing member, which is made of a porous material, is disposed in a rear of said first communication hole.

9. The direct-fluid-supply writing device according to claim 8, wherein a capillary attraction of said ink keeping member is larger than a capillary attraction of said ink occuluding member and smaller than said capillary attraction of said ink inducing member.

10. The direct-fluid-supply writing device according to claim 1, wherein a capillary attraction of said second communication hole is larger than a capillary attraction of said first communication hole.

* * * * *